US008125503B2

(12) United States Patent
Sugimoto

(10) Patent No.: US 8,125,503 B2
(45) Date of Patent: Feb. 28, 2012

(54) IMAGE FORMING APPARATUS

(75) Inventor: Tasuku Sugimoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 560 days.

(21) Appl. No.: 12/329,021

(22) Filed: Dec. 5, 2008

(65) Prior Publication Data

US 2009/0147068 A1 Jun. 11, 2009

(30) Foreign Application Priority Data

Dec. 7, 2007 (JP) ..... 2007-317098

(51) Int. Cl.
*B41J 2/44* (2006.01)

(52) U.S. Cl. ..... 347/133; 347/236

(58) Field of Classification Search ..... 347/132, 347/133, 235, 236, 250
See application file for complete search history.

(56) References Cited

U.S. PATENT DOCUMENTS

| | | | | |
|---|---|---|---|---|
| 4,201,994 | A * | 5/1980 | Hoshito et al. | 347/246 |
| 4,443,695 | A * | 4/1984 | Kitamura | 250/205 |
| 4,695,714 | A * | 9/1987 | Kimizuka et al. | 250/205 |
| 4,935,615 | A * | 6/1990 | Yoshida Eiichi et al. | 250/205 |

FOREIGN PATENT DOCUMENTS

| | | |
|---|---|---|
| JP | 11-091163 | 4/1999 |
| JP | 2002-244055 | 8/2002 |
| JP | 2005-335353 | 12/2005 |

* cited by examiner

*Primary Examiner* — Huan Tran
(74) *Attorney, Agent, or Firm* — Banner & Witcoff, Ltd.

(57) ABSTRACT

An image forming apparatus is provided. The image forming apparatus includes a semiconductor laser that emits a laser beam, a light power of the laser beam being controllable by a current applied to the semiconductor laser; a scanner unit that exposes a photosensitive element by scanning the photosensitive element using the laser beam; a light power detection unit that detects a light power of the laser beam; a current control unit that controls the current applied to the laser based on the light power of the laser beam; a home position detection unit that detects whether the laser beam is positioned at a scan home position; and a continuous illumination unit that commences continuous illumination of the laser at a time which is prior to a forecast time at which the home position detection unit is forecast to detect the laser beam.

8 Claims, 8 Drawing Sheets

IMAGE FORMING APPARATUS

CROSS REFERENCE TO RELATED APPLICATION

The present application claims priority from Japanese Patent Application No. 2007-317098, which was filed on Dec. 7, 2007, the disclosure of which is herein incorporated by reference in its entirety.

TECHNICAL FIELD

Apparatuses consistent with the present invention relate to an image forming apparatus and, more particularly, to an image forming apparatus featuring control of the light power of a laser beam used for subjecting photosensitive elements to scan exposure.

BACKGROUND

Japanese unexamined patent application publication No. JP-A-2002-244055 (Hereinafter, Patent Document 1) describes a related art image forming apparatus. The related art image forming apparatus generates an image by subjecting photosensitive elements to scan exposure through use of a laser beam originating from a semiconductor laser, or the like. It has been proposed that the related art image forming apparatus of this type be equipped with a beam detect (BD) sensor. When the laser beam reaches a home position, the laser is forcibly illuminated. The BD sensor detects the continuous illumination of the laser beam at the scan home position for scan exposure and generates a BD signal. The laser beam is then modulated in accordance with image data on the basis of a detection timing of the BD signal. It has also been proposed that the related art image forming apparatus of this type enable adjustment of a timing at which the semiconductor laser is forcibly illuminated in order for the BD sensor to detect the laser beam. The adjustment of the timing can be made, for example, according to a characteristic of a scanner motor for deflecting the laser beam.

Although not described in Patent Document 1, it has also been proposed to commence continuous illumination at a predetermined period corresponding to the predetermined scan speed before the detection of the BD signal, to control an electric current applied to the semiconductor laser for a period before the BD signal is detected, and to adjust an amount of the laser beam.

SUMMARY

In the above-described related art image forming apparatus, a scan speed of the laser beam is not necessarily constant, and the scan speed may abruptly increase especially at the time of activation of a polygon motor, or depending on an environment temperature, or the like. In such a case, when the semiconductor laser is forcibly caused to illuminate light at a timing corresponding to the predetermined scan speed, the BD signal is detected immediately after initiation of the continuous illumination. This immediate detection raises the possibility of a failure to assure a time used to control energization current.

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus that can stably control an energization current for a semiconductor laser regardless of fluctuations in scan speed.

According to an exemplary embodiment of the present invention, there is provided an image forming apparatus comprising a semiconductor laser that emits a laser beam according with a current to be applied; a scanner unit that subjects a photosensitive element to scan exposure by means of the laser beam originating from the semiconductor laser; a light power detection unit that detects a light power of laser beam from the semiconductor laser; a current control unit that controls the current applied to the semiconductor laser according with the light power detected by the light power detection unit; a home position detection unit that detects the laser beam at a scan home position of the scanner unit; and a continuous illumination unit that induces continuous illumination of the semiconductor laser for operation of the current control unit and the home position detection unit, wherein the continuous illumination unit commences continuous illumination of the semiconductor laser at timing, a period of time longer than required for control to be performed by the current control unit, ahead of timing at which the home position detection unit is forecast to detect the laser beam.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

[Overall Configuration of a Laser Printer]

Figure 1:
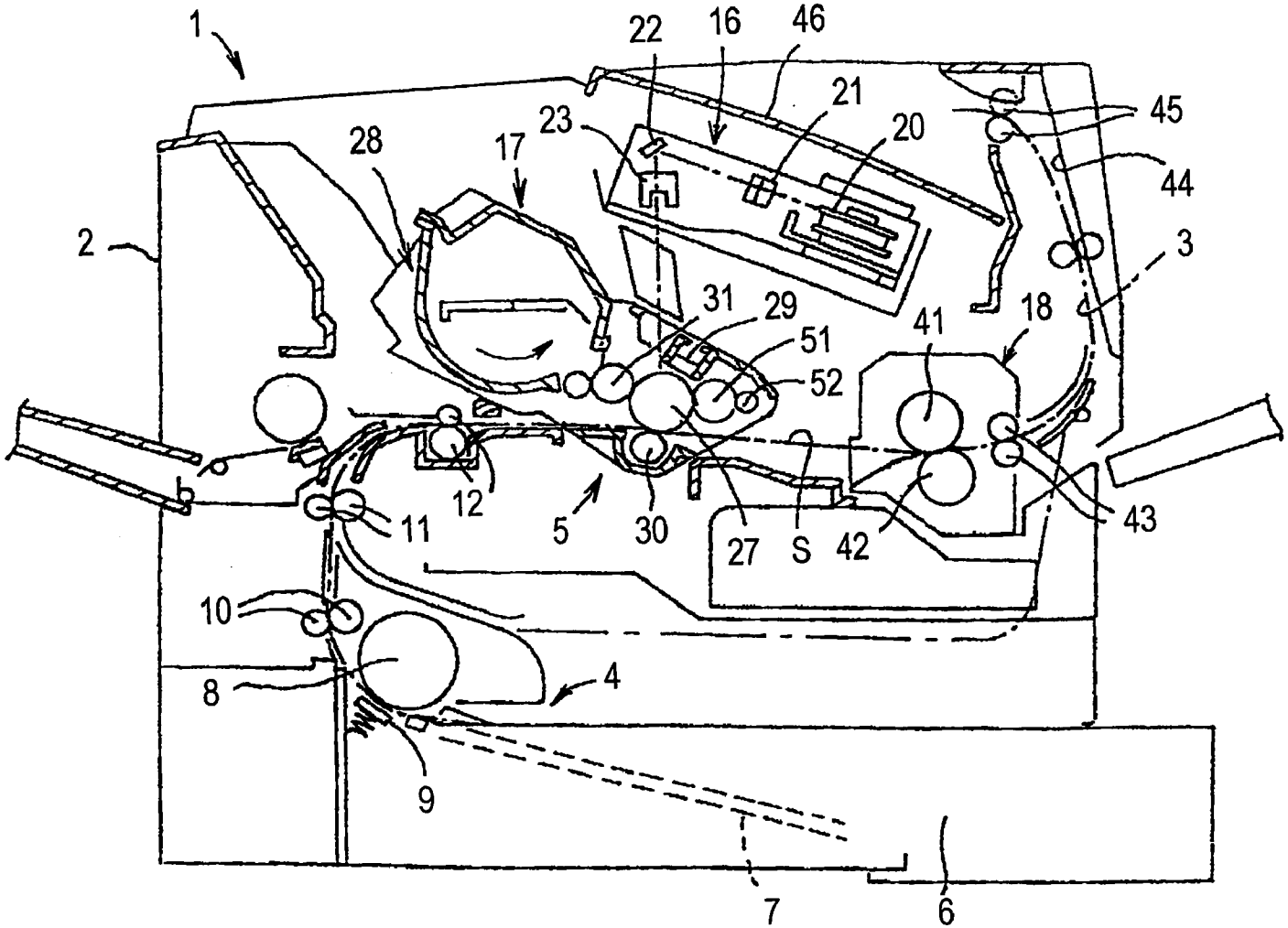
FIG. 1 is a schematic cross-sectional view showing a configuration of a laser printer according to an exemplary embodiment of the present invention.
Figure 2:
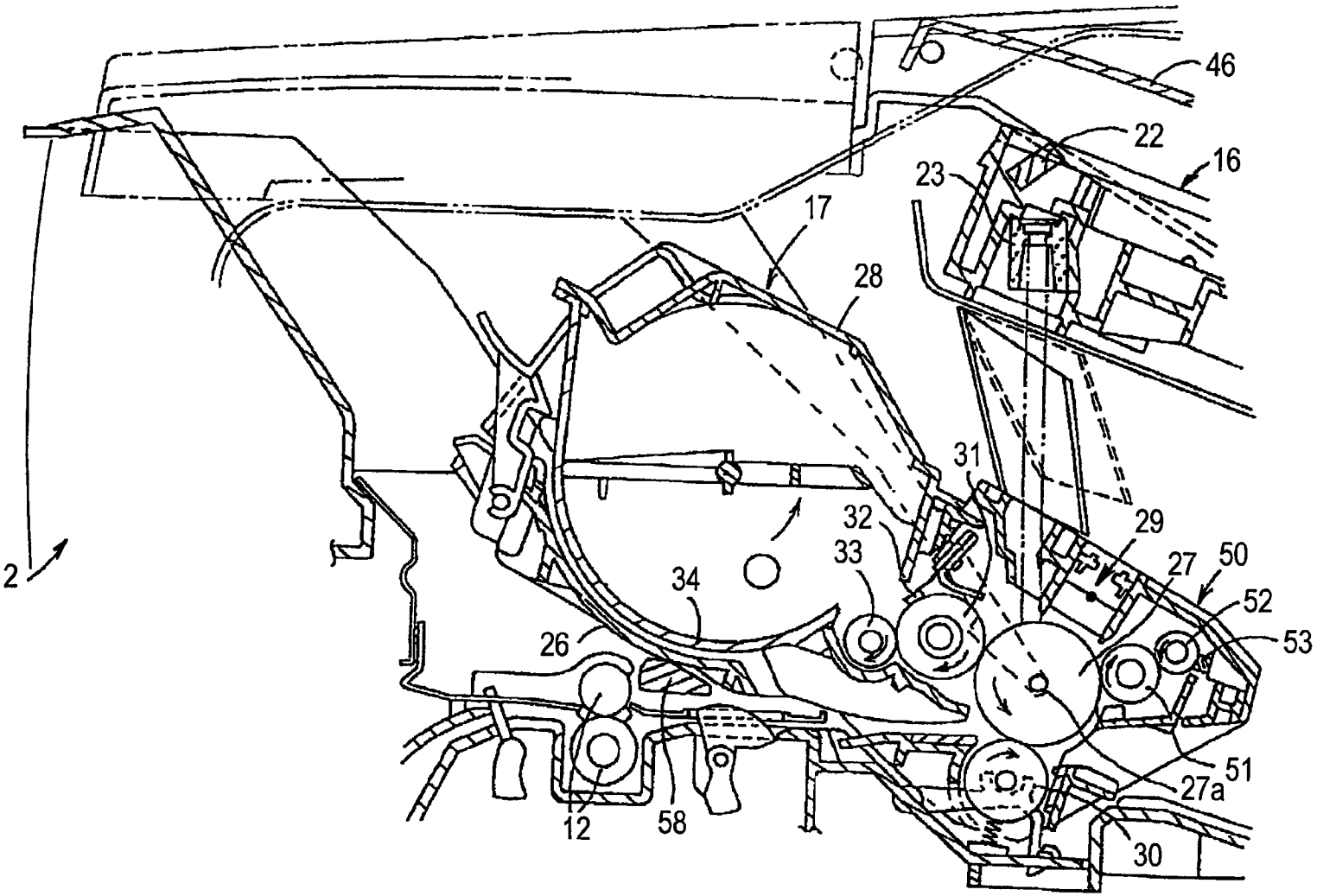
FIG. 2 is an enlarged lateral cross-sectional view of an image forming section of the laser printer of FIG. 1.

Exemplary embodiments of the present invention will now be described by reference to the drawings. FIG. 1 is a schematic lateral cross-sectional view showing the configuration of a laser printer 1 serving as an example of an image forming apparatus to which the present invention is applied; and FIG. 2 is an enlarged lateral cross-sectional view showing an image forming section 5 of the laser print 1 serving as an image forming unit of the laser printer 1. As shown in FIG. 1, the laser printer 1 has, within a main-body case 2, a feeder section 4 for feeding a sheet 3 acting as an example of a recording medium, an image forming section 5 for generating an image on the thus-fed sheet 3, and the like.

The feeder section 4 has a sheet feeding tray 6 removably attached to a bottom of the laser printer 1 within the main-body case 2; a sheet press plate 7 provided in the sheet feeding tray 6; a sheet feeding roller 8 and a sheet feeding pad 9 that are provided at elevated positions above a single-side end of the sheet feeding tray 6; paper powder removal rollers 10 and conveyance rollers 11 that are disposed downstream of the sheet feeding roller 8 in the direction of conveyance of the sheet 3; and a registration roller 12 disposed downstream of the conveyance roller 11 in the direction of conveyance of the sheet 3.

The topmost sheet 3 on the sheet press plate 7 is pressed toward the sheet feeding roller 8 by a spring (not illustrated) from the back of the sheet press plate 7, to thus be nipped between the sheet feeding roller 8 and the sheet feeding pad 9 by rotation of the sheet feeding roller 8 and subsequently fed one at a time. After paper powder of the thus-fed sheet 3 has been removed by the paper powder removal rollers 10, the sheet 3 is delivered to the registration roller 12 by the conveyance rollers 11. The registration roller 12 comprises a pair of rollers and arranged so as to send the sheet 3 to an image-forming position after having subjected the sheet to registration. Here, the image-forming position is a location where a toner image is transferred to the sheet 3. In the present exemplary embodiment, the image-forming position is a location where a photosensitive drum 27 contacts a transfer roller 30.

The image forming section 5 has a scanner unit 16 serving as an exposure unit, a process unit 17, and a fixing section 18. The scanner unit 16 is placed on a lower surface side of a sheet discharge tray 46 within an upper inner portion of the main-body case 2. The scanner unit 16 has a laser diode unit 19 (see FIG. 3), a polygon mirror 20 acting as an example of a scanner unit that is rotationally driven, lenses 21 and 23, a reflection mirror 22, and the like. The scanner unit 16 causes the laser beam emitted by a laser diode LD (see FIG. 4), which is housed in a laser diode unit 19 and which serves as an example of a semiconductor laser, to pass through in sequence a polygon mirror 20, a lens 21, a reflection mirror 22, and a lens 23 or to undergo reflection on them in sequence as indicated by a chain line, thereby subjecting the surface of the photosensitive drum 27 (an example of a photosensitive element) in the process unit 17 to scan exposure.

As shown in FIG. 2, the process unit 17 has in a drum cartridge 26, the photosensitive drum 27, a scorotron-type electrifier 29, a transfer roller 30, a cleaning roller 51 serving as a paper powder cleaner 50, a secondary roller 52, a frictional-contact member 53, and the like.

The photosensitive drum 27 is arranged so as to be able to rotate in the direction of an arrow (e.g., a counterclockwise direction in FIG. 2) at the side of a developing roller 31, which serves as a developing unit, in a state of opposing the developing roller 31. A rotational center shaft 27*a* acting as a drive shaft of the photosensitive drum 27 projects from both lateral sides of the drum cartridge 26 and is configured so as to be rotationally driven by power from a main motor (not illustrated).

The scorotron-type electrifier 29 serving as an electrifying unit is upwardly spaced a predetermined interval from the photosensitive drum 27 so as not to contact the same. The surface of the photosensitive drum 27 is first evenly electrified with positive polarity by the scorotron-type electrifier 29 along with rotation of the photosensitive drum 27, and subsequently the surface is exposed to a laser beam from the scanner unit 16 by a high-speed scan, whereupon an electrostatic latent image based on image data is generated.

The transfer roller 30 is disposed below the photosensitive drum 27 so as to oppose the same and is supported by the drum cartridge 26 so as to be able to rotate in the direction of an arrow (e.g., a clockwise direction in FIG. 2). A metal roller shaft is covered with a roller formed from an ionic conductive rubber material, and the transfer roller 30 is configured so as to be applied with a transfer bias (e.g., a forward transfer bias) from a transfer bias application power source during transfer operation. Therefore, a visible image carried on the surface of the photosensitive drum 27 is transferred onto the sheet 3 during the course of the sheet 3 passing between the photosensitive drum 27 and the transfer roller 30.

A developing cartridge 28 is removably attached to the drum cartridge 26 and includes the developing roller 31, a layer thickness regulation blade 32, a supply roller 33, a toner box 34, and the like. The toner box 34 is filled with nonmagnetic monocomponent toner as a developing agent having a positive electrification characteristic.

As shown in FIG. 1, the fixing section 18 is disposed at the side of and downstream of the process unit 17. The fixing section 18 has a heating roller 41, a press roller 42 that presses the heating roller 41, and a pair of conveyance rollers 43 disposed downstream of the heating roller 41 and the press roller 42. The heating roller 41 has a metal halogen lamp and is arranged so as to thermally fix the toner transferred onto the sheet 3 in the process unit 17 during the course of the sheet 3 passing between the heating roller 41 and the press roller 42 and to subsequently convey the sheet 3 to a sheet discharge path 44 by means of a conveyance roller 43. The sheet 3 sent to the sheet discharge path 44 is delivered to a sheet discharge roller 45 and ejected onto a sheet discharge tray 46 by means of the sheet discharge roller 45.

[Configuration of the Scanner Unit and a Control System Thereof]

Figure 3:
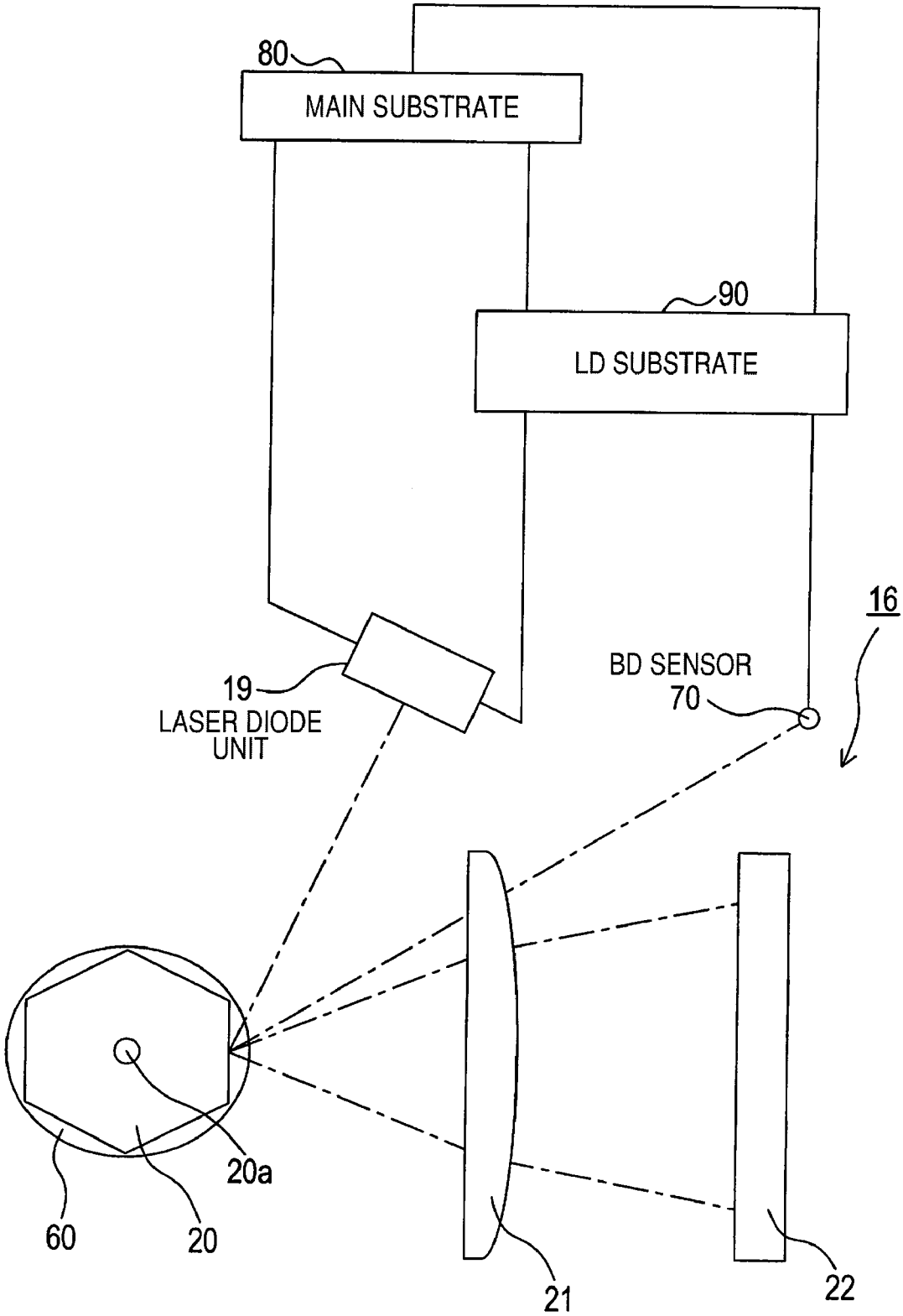
FIG. 3 is a descriptive view showing a configuration of a control system of a scanner unit of the laser printer of FIG. 1.

Next, the configuration of the scanner unit 16 will be described. As shown in FIG. 3, the polygon mirror 20 is rotationally driven around a rotary shaft 20*a* by a polygon motor 60. A laser beam exited from the laser diode unit 19 is subjected to a scan in an axial direction (in the direction of a main scan) of the photosensitive drum 27 in accordance with rotation of the polygon mirror 20, to thus reach the surface of the photosensitive drum 27 as mentioned above by way of the lens 21, the reflection mirror 22, and the like. Abeam detect (BD) sensor 70 serving as an example of a home position detection unit is provided at one corner in the scan range of the laser beam (i.e., outside the range where the laser beam reaches the photosensitive drum 27).

The polygon motor 60 is controlled by a motor drive voltage from a main substrate 80. A hole signal and a frequency generator (FG) signal are output from the polygon motor 60 to the main substrate 80. A lock signal is generated in the main substrate 80 when the rotational speed of the polygon motor 60 is controlled so as to fall within a predetermined range, based on the hole signal and the FG signal. Further, the laser diode unit 19 is controlled by the main substrate 80 by way of a laser diode (LD) substrate 90, and a detection signal of the BD sensor 70 is also provided to the main substrate 80 by way of the LD substrate 90.

Figure 4:
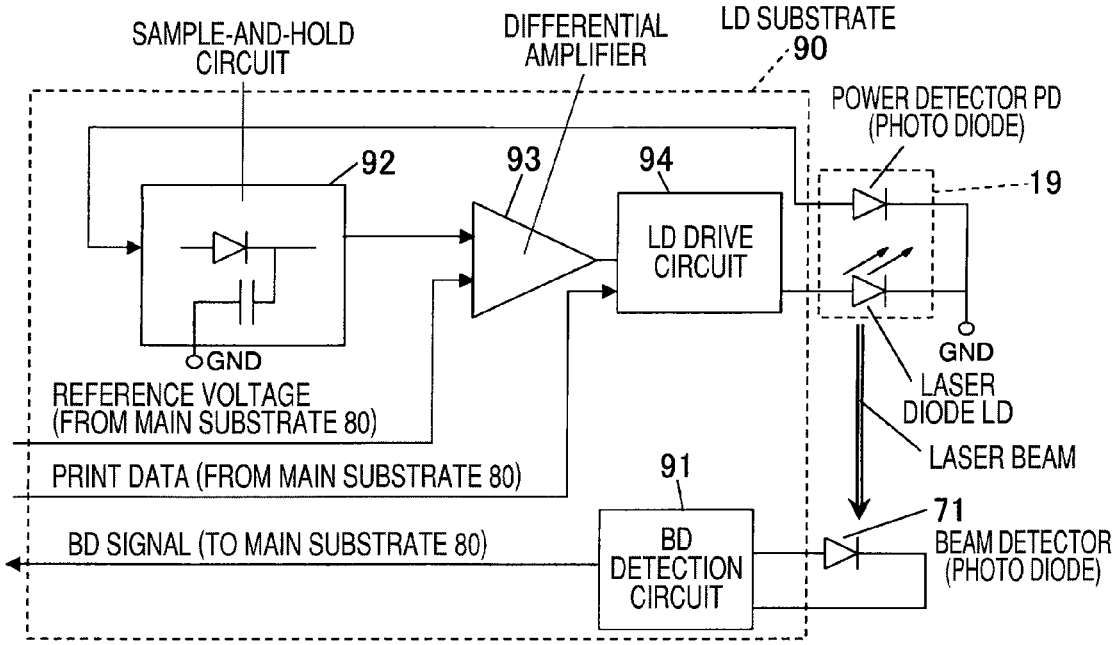
FIG. 4 is a block diagram showing the configuration of a laser diode (LD) substrate of the scanner unit of the laser printer of FIG. 1.

FIG. 4 is a block diagram showing a schematic configuration of the laser diode 19 and the LD substrate 90 in more detail. When a laser beam is received by the BD sensor 70, the state of conduction of a BD diode 71 incorporated in the BD sensor 70 changes as shown in FIG. 4. The LD substrate 90 is provided with a BD detection circuit 91 that generates a BD signal at a time of a change in the state of conduction of the BD diode 71 and outputs the BD signal to the main substrate 80.

The laser diode unit 19 incorporates a laser diode (LD) for generating a laser beam and a power detect diode (PD) serving as an example of a light power detection unit for detecting the light power [W] of a laser beam. A voltage generated by circuitry including the power detect diode PD according to the light power is held for a given period of time by a sample-and-hold circuit 92 provided on the LD substrate 90. In addition to the sample-and-hold circuit, the LD substrate 90 has a differential amplifier 93 that amplifies a difference between the voltage held by the sample-and-hold circuit 92 and a reference voltage from the main substrate 80. An LD drive circuit 94 controls a current applied to the laser diode LD in accordance with an output from the differential amplifier 93.

Therefore, the LD substrate 90 can perform a so-called calibration for controlling the current applied to the laser diode LD in such a way that the quantity of the laser beam received by the power detect diode PD comes to a light power corresponding to the reference voltage. Specifically, the sample-and-hold circuit 92, the differential amplifier 93, and the LD drive circuit 94 correspond to an example of a current control unit. Moreover, print data (print DATA) serving as example of image data is input to the LD drive circuit 94 from the main substrate 80, and the laser beam is modulated in accordance with the print data during a period in which the photosensitive drum 27 is scanned by the laser beam.

[Control Performed by a Scanner Unit Control System]

Figure 5:
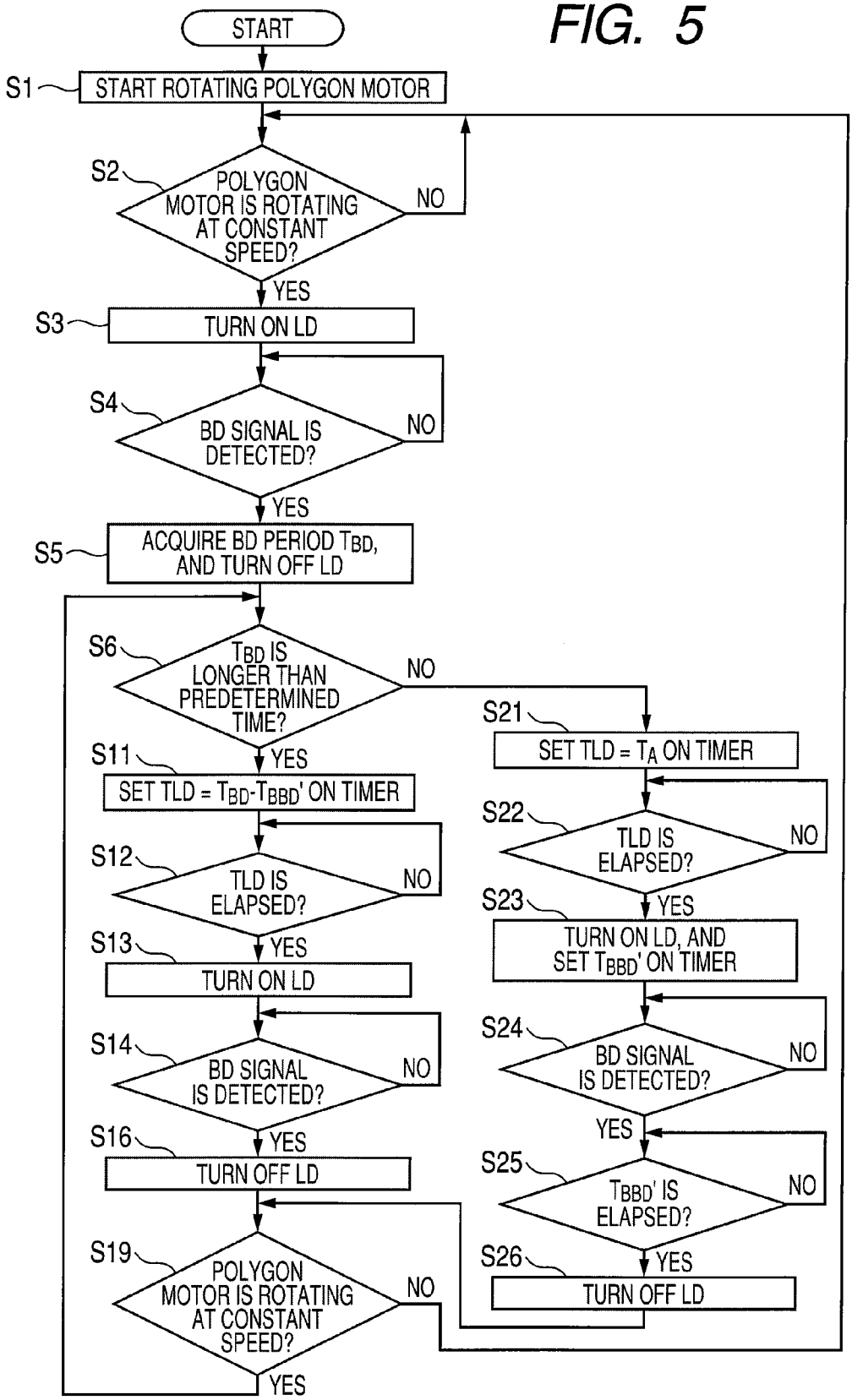
FIG. 5 is a flowchart showing continuous illumination processing performed by the control system of FIG. 3.

Continuous illumination processing serving as an example of a continuous illumination unit that induces continuous illumination of the laser diode LD to detect the BD signal and perform calibration will now be described. FIG. 5 is a flowchart showing continuous illumination processing. The main substrate 80 has a CPU, ROM, and RAM and commences processing when the power of the laser printer 1 is turned on.

As shown in FIG. 5, when processing is commenced, the polygon motor 60 is first activated in S1 (reference symbol "S" denotes an operation, and the same also applies to any counterparts in the following descriptions). In S2, it is determined whether the polygon motor 60 is rotated at a constant speed; namely, whether the lock signal is generated as a result of the rotational speed of the polygon motor 60 being controlled in the predetermined range. If the rotational speed of the polygon motor 60 is low (e.g., at a time immediately after activation of the polygon motor) (N in S2), processing remains in a standby state in S2. When the lock signal is generated as a result of the rotational speed of the polygon motor 60 increasing to a given speed or higher (Y in S2), processing proceeds to S3.

In S3, the laser diode LD is forcedly illuminated (also called activated in the following descriptions), and it is determined, in S4, whether the BD signal is detected (whether BD signal output from the BD detection circuit is ON or OFF) If the BD signal cannot be detected (regardless of whether the laser light is input to the beam detector 71, the BD signal, which is output from the BD detection circuit, keeps OFF-state) (N in S4), processing stays in a standby condition in S4. For example, immediately after the laser diode LD has been turned on, the light power is small, and the processing stays in a standby condition. On the other hand, if the BD signal is detected (e.g., as a result of an increase in the light power of the laser diode LD) (Y in S4), processing proceeds to S5. In S5, an interval between detection of two continual BD signals is acquired as a BD period $T_{BD}$, and the laser diode LD is turned off. Subsequently, in S6 which acts as one example of a determination unit, processing is switched to "First Control Processing" or "Second Control Processing" based on whether the PD period $T_{BD}$ acquired in S5 is longer than a sum of a calibration time $T_{BBD}'$ plus a continuous illumination restricted area $T_A$ ($T_{BBD}'+T_A$).

The calibration time $T_{BBD}'$ is a time that is required for calibration for keeping an amount of the laser light of laser diode LD constant. Regardless of the rotational speed of the polygon motor 60, $T_{BBD}'$ needs a given time.

The continuous illumination restricted area $T_A$ is a time in which there is a possibility that the laser light exposes the photosensitive drum 27 and has an influence on image formation when the laser diode LD is forcibly illuminated after detecting the BD signal. In addition, the continuous illumination restricted area $T_A$ may be calculated as a time $T_{A1}$ in which the laser light exposes the photosensitive drum 27. Further, the continuous illumination restricted area $T_A$ may be calculated as a time $T_{A2}$ in which the laser light actually has an influence on image formation while taking a width of the paper 3 into consideration. Further, the continuous illumination restricted area $T_A$ may be calculated as a time that is shorter than $T_{A1}$ and that is longer than $T_{A2}$.

Here, in the present exemplary embodiment, "First Control Processing" and "Second Control Processing" are switchably executed based on whether the PD period $T_{BD}$ is longer than the sum of the calibration time $T_{BBD}'$ plus the continuous illumination restricted area $T_A$ ($T_{BBD}'+T_A$).

<First Control Procedure>

Figure 6:
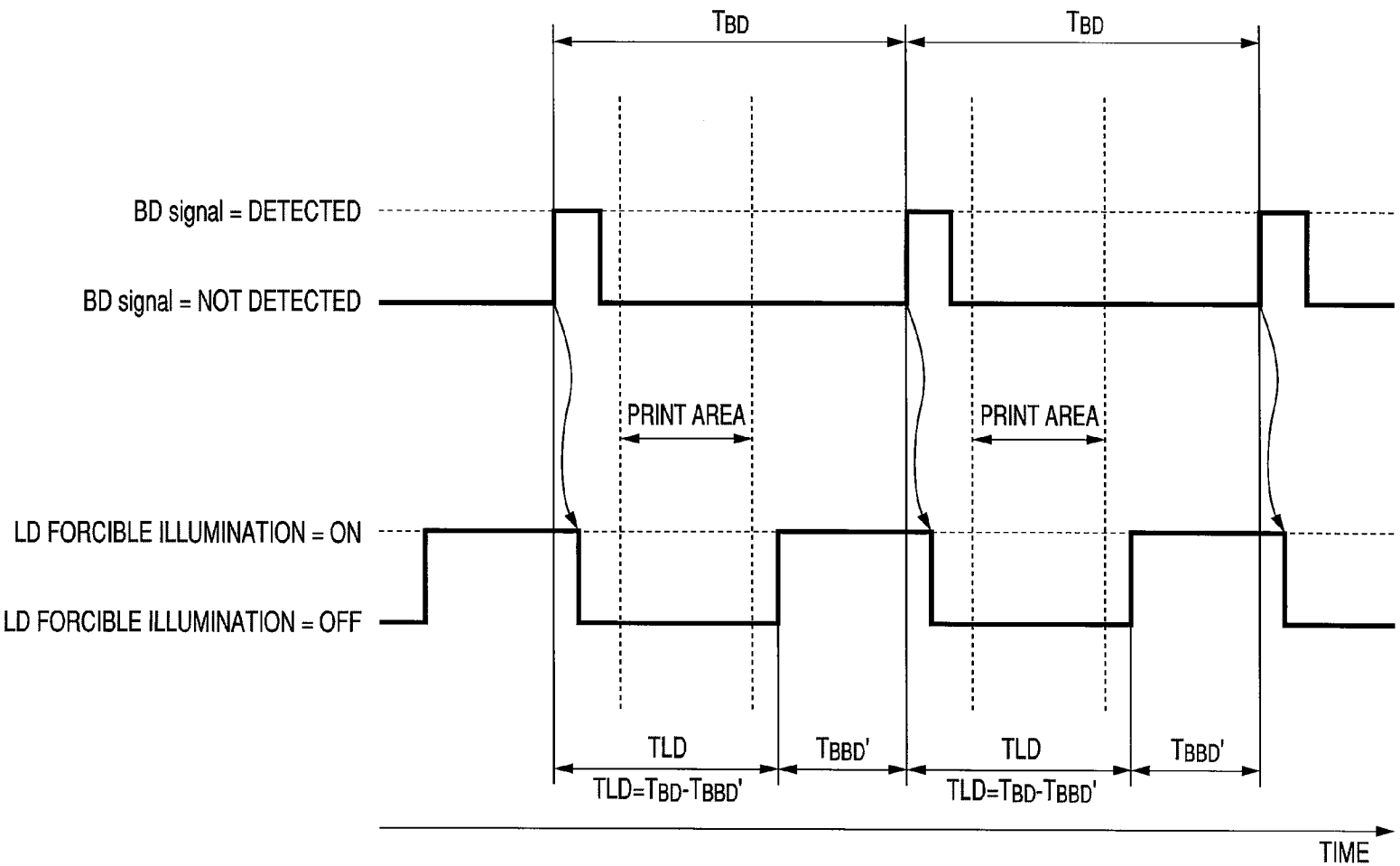
FIG. 6 is a timing chart showing the continuous illumination processing of FIG. 5 when abeam detect (BD) period is long.

First Control Procedure is indicated in a timing chart shown in FIG. 6 and S6 to S16 of the flow chart shown in FIG. 5. As indicated in FIG. 6, in the First Control Procedure, a continuous illumination of the laser diode LD is commenced at timing which is $T_{BBD}'$ ahead of the timing of detection of the BD signal, and the continuous illumination of the laser diode LD is terminated at the same time as detection of the BD signal (In the present exemplary embodiment, a detection time of the BD signal is a rising time in which output signal from the BD detection circuit is switched from OFF to ON).

Hereinafter, First Control Processing is explained with FIG. 5.

If the BD period $T_{BD}$ is longer than the sum of the calibration time $T_{BBD}'$ plus the continuous illumination restricted area $T_A$ ($T_{BBD}'+T_A$) (Y in S6), processing proceeds to S11. At S11, where a time TLD which is defined by the equation $TLD=T_{BD}-T_{BBD}'$ is computed, and the resultant TLD is set on the timer. In S12, it is determined whether the time TLD has elapsed. If it is determined that TLD has not elapsed (NO in S12), processing remains in a standby state. If it is determined that the TLD has elapsed (Y in S12), processing proceeds to S13. At S13, the laser diode LD is turned on. At S14, it is determined whether the BD signal is detected. If the BD signal is not detected (N in S14), processing remains in a standby state. If the BD signal is detected (Yin S14), the laser diode LD is turned off at S16.

As shown in FIG. 6, by processing from operation S11 to operation S16, the laser diode LD is turned on at timing $T_{BBD}'$ ahead of the timing of detection of the BD signal (S13), so that a time used for calibration can be ensured. In this case, the laser diode LD can be turned off immediately after detection of the BD signal (S16).

According to First Control Procedure, there is an advantage that it is unnecessary to measure the continuous illumination time of the laser diode LD with the timer and the control Procedure becomes easier.

When the rotational speed of the polygon motor 60 is fast and when the BD period $T_{BD}$ is shorter (not longer) than the sum of the calibration time $T_{BBD}'$ plus the continuous illumination restricted area $T_A$ ($T_{BBD}'+T_A$), the continuous illumination of the laser diode LD is commenced before the continuous illumination restricted area $T_A$ is terminated. As a result, there is a possibility of, when continuous illumination of the laser diode LD is commenced, the photosensitive drum 27 being exposed to the laser beam, to thus affect formation of an image.

Figure 7:
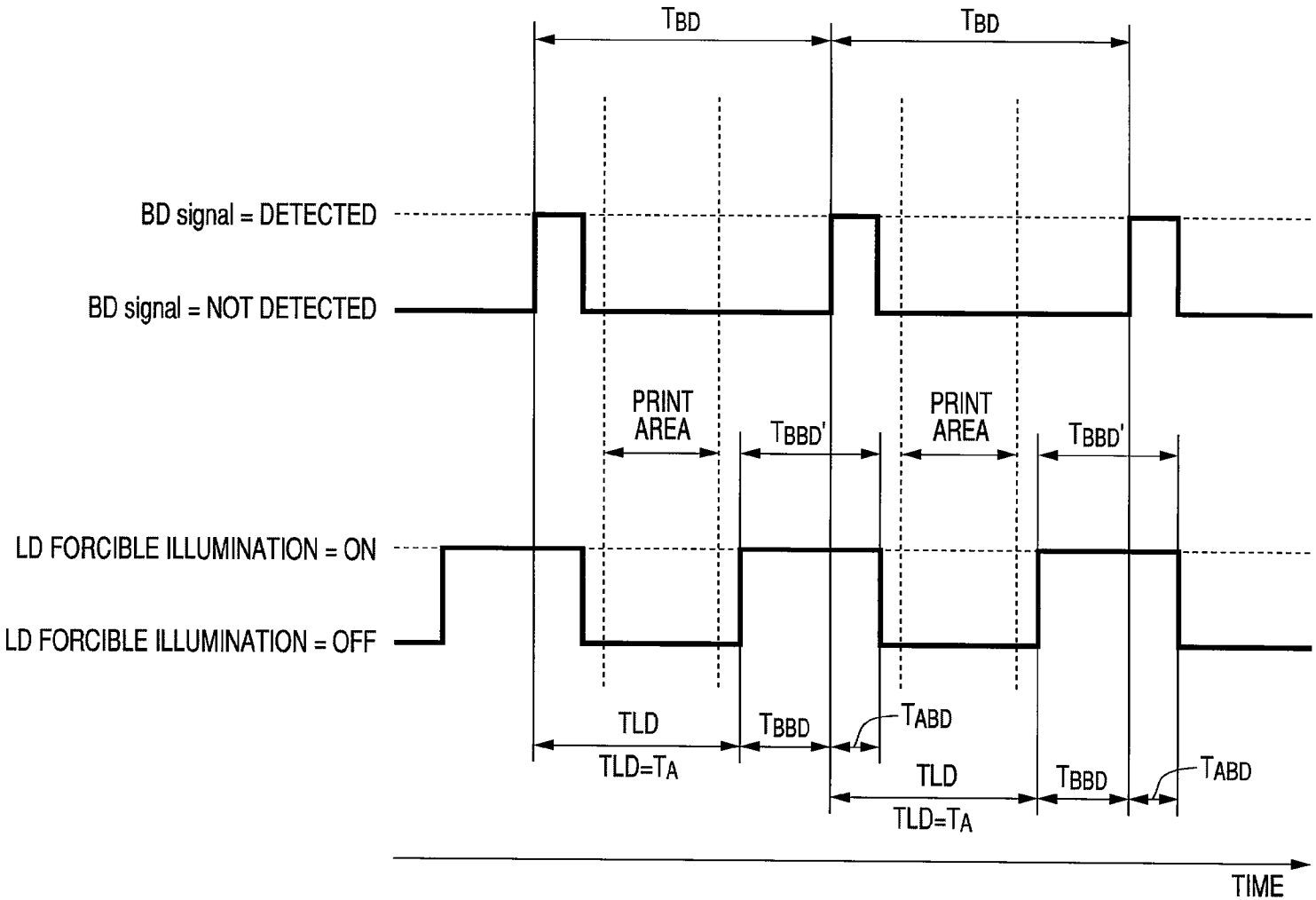
FIG. 7 is a timing chart showing the continuous illumination processing of FIG. 5 when the BD period is short.

In such a case, Second Control Procedure, which is indicated in the timing chart of FIG. 7, is executed in the present exemplary embodiment.

<Second Control Procedure>

Second Control Procedure is indicated in the timing chart shown in FIG. 7 and S21 to S26 of the flow chart show in FIG. 5.

In Second Control Procedure, continuous illumination is commenced after an elapse of a time (continuous illumination restricted area $T_A$) in which the continuous illumination has an influence on image formation, and the time of the continuous illumination is prolonged even after detection of the BD signal. That is, even if the BD signal is detected, the laser diode LD is not switched to Off-state after the continuous illumination is commenced. And, the laser diode LD is forcibly illuminated until the calibration time $T_{BBD}'$ is secured.

In FIG. 7, a continuous illumination time achieved before detection of the BD signal is represented as $T_{BBD}$ and a continuous illumination time achieved after detection of the BD signal is represented as $T_{ABD}$, and $T_{BBD}'=T_{BBD}+T_{ABD}$ is achieved. The print area $T_A$ is computed by the main substrate 80 at the timing of detection of the BD signal. The continuous illumination restricted area $T_A$ may also be computed as a period during which the photosensitive drum 27 is exposed to the laser beam.

Hereinafter, Second Control Processing is specifically explained with FIG. 5.

Returning to S6 in FIG. 5, if it is determined that the BD period $T_{BD}$ is not longer than the sum of the calibration time $T_{BBD}'$ plus the continuous illumination restricted area $T_A$ ($T_{BBD}'+T_A$) (N in S6), processing proceeds to S21. At S21, the time TLD is taken as the foregoing continuous illumination restricted area $T_A$ and the TLD is set on the timer. In S22, it is determined whether TLD has elapsed. If it is determined that TLD has not elapsed (N in S22), the processing remains in a standby state. If it is determined that TLD has elapsed (Y in S22), processing proceeds to S23. At S23, the laser diode LD is turned on and the $T_{BBD}'$ is set on the timer. In S24, it is determined whether the BD signal is detected. If it is determined that the BD signal is not detected (N in S24), processing remains in a standby state. If it is determined that the BD signal is detected (Y in S24), processing proceeds to S25. In S25, it is determined whether the time $T_{BBD}'$ set in S23 has elapsed. If it is determined that the time $T_{BBD}'$ has not elapsed (N in S25), processing remains in a standby state. If it is determined that the $T_{BBD}'$ has elapsed (Y in S25), processing proceeds to S26. In S26, the laser diode LD is turned off, and processing proceeds to S19.

As shown in FIG. 7, the laser diode LD is forcedly illuminated only for a period of $T_{BBD}'$ after elapse of the continuous illumination restricted area $T_A$ by means of processing pertaining to S21 through S26 mentioned above. In this case, the continuous illumination period of the laser diode LD is prolonged even after detection of the BD signal. Hence, a case where BD period $T_{BD}$ is short can be addressed. As mentioned above, in the present exemplary embodiment, even when fluctuations arise in the scan speed of the laser beam as a result of occurrence of variations in the rotational speed of the polygon motor 60, calibration can be stably carried out by assuring the continuous illumination period of the laser diode LD.

<Processing after First Control Procedure of Second Control Procedure>

Hereinafter, processing after First Control Procedure or Second Control Procedure is explained with the flow chart of FIG. 5.

When the above described First Control Procedure or Second Control Procedure is terminated, processing proceeds to S19.

Following S16, in S19, based on the lock signal is generated, it is determined whether the rotational speed of the polygon motor 60 is controlled so as to fall within a threshold range (i.e., a given speed). If it is determined that the rotational speed of the polygon motor 60 is controlled so as to fall within the threshold range (Y in S19), processing proceeds to S6. In contrast, if it is determined that the rotational speed is not controlled so as to fall within the threshold range (N in S19), processing proceeds to S2, at which processing stays in the standby state until the rotational speed of the polygon motor 60 falls within the threshold range.

Figure 8:
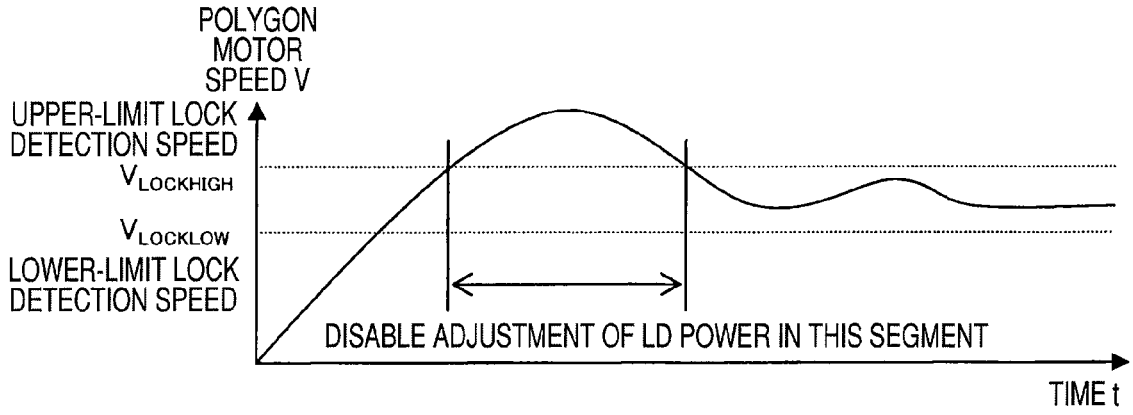
FIG. 8 is a timing chart showing operation for interrupting the continuous illumination processing of FIG. 5 according to a lock signal.

When the lock signal is not generated as a result of the rotational speed of the polygon motor 60 having fallen out of the threshold range (N in S19), various false operations, such as a failure to accurately detect the BD signal during the course of continuous illumination of the laser diode LD, may arise. Accordingly, as exemplified in a timing chart of FIG. 8, when the rotational speed of the polygon motor 60 (i.e., a polygon motor speed V) is not between the upper limit at which the lock signal is generated (i.e., an upper-limit LOCK detection speed $V_{LOCKHIGH}$) and the lower limit at which the lock signal is generated (i.e., a lower-limit LOCK detection speed $V_{LOCKLOW}$), calibration (i.e., adjustment of LD power) effected by foregoing processing is turned off. When the lock signal is again generated (Y in S2), processing is resumed. Therefore, the calibration, which is performed by the above described processing, is interrupted when the lock signal is not generated (S19 and S1), whereby occurrence of a faulty operation can be prevented more often. For example, it is prevented that an accurate calibration is not performed due to insufficient time of the calibration time $T_{BBD}'$ thereby a faulty operation is occurred.

The present invention is not limited to the above described exemplary embodiment and can be implemented in various forms without departing from the spirit and scope of the invention. For instance, the main substrate 80 may also be able to perform either processing pertaining to S11 to S16 or processing pertaining to S21 to S26. Moreover, the present inventive concept can be applied to various pieces of electrophotographic image forming apparatus, such as a copier, a facsimile, and a color laser printer. Moreover, the scanner unit of the present invention may also be a galvanometer mirror, and the like.

According to exemplary embodiments of the present invention, there is provided an image forming apparatus comprising a semiconductor laser that emits a laser beam according with a current to be applied; a scanner unit that subjects a photosensitive element to scan exposure by means of the laser beam originating from the semiconductor laser; a light power detection unit that detects a light power of laser beam from the semiconductor laser; a current control unit that controls the current applied to the semiconductor laser according with the light power detected by the light power detection unit; a home position detection unit that detects the laser beam at a scan home position of the scanner unit; and a continuous illumination unit that induces continuous illumination of the semiconductor laser for operation of the current control unit and the home position detection unit, wherein the continuous illumination unit commences continuous illumination of the semiconductor laser at timing, a period of time longer than required for control to be performed by the current control unit, ahead of timing at which the home position detection unit is forecast to detect the laser beam.

Accordingly, the scanner unit subjects the photosensitive element to scan exposure by the laser beam originating from the semiconductor laser. Moreover, the continuous illumination unit induces continuous illumination of the semiconductor laser, and the light power detection unit detects the light power of the laser beam from the semiconductor laser during the course of continuous illumination of the semiconductor laser. Further, the current control unit controls the current applied to the semiconductor laser on the basis of the thus-detected light power. Moreover, during continuous illumination, the home position detection units detect the laser beam at the scan home position of the scanner unit.

The continuous illumination unit commences continuous illumination of the semiconductor laser at timing, a period of time longer than used for control to be performed by the current control unit, ahead of timing at which the home position detection unit is forecast to detect the laser beam. Wherefore, according to exemplary embodiments of the present invention, even when variations arise in the scan speed of the scanner unit, the current control unit can stably control, in the middle of continuous illumination, the current to be applied. Moreover, according to exemplary embodiments of the present invention, the home position detection unit detects the laser beam when continuous illumination is carried out for the period of time used for control to be performed by the current control unit. Hence, after the home position detection unit has detected the laser beam, continuous illumination can be immediately terminated.

According to another exemplary embodiment of the present invention, there is provided an image forming apparatus comprising a semiconductor laser that emits a laser beam according with a current to be applied; a scanner unit that subjects a photosensitive element to scan exposure by the laser beam originating from the semiconductor laser; a light power detection unit that detects a light power of laser beam from the semiconductor laser; a current control unit that controls the current applied to the semiconductor laser according to the light power detected by the light power detection unit; a home position detection unit that detects the laser beam at a scan home position of the scanner unit; and a continuous illumination unit that induces continuous illumination of the semiconductor laser for operation of the current control unit and the home position detection unit, wherein the continuous illumination unit computes a period, from the timing at which the home position detection unit has detected the laser beam, during which illumination of the semiconductor laser affects formation of an image; commences continuous illumination of the semiconductor laser after elapse of the period; and terminates continuous illumination of the semiconductor laser after elapse of a time used for control to be performed by the current control unit.

Accordingly, the scanner unit subjects the photosensitive element to scan exposure by the laser beam originating from the semiconductor laser. Moreover, the continuous illumination unit induces continuous illumination of the semiconductor laser, and the light power detection unit detects the light power of the laser beam from the semiconductor laser during the course of continuous illumination of the semiconductor laser. Further, the current control unit controls the current applied to the semiconductor laser on the basis of the thus-detected light power. Moreover, the home position detection unit detects the laser beam at the scan home position of the scanner unit during continuous illumination.

The continuous illumination unit computes a period, from the timing at which the home position detection unit has detected the laser beam, during which illumination of the semiconductor laser affects formation of an image; commences continuous illumination of the semiconductor laser after elapse of the period; and terminates continuous illumination of the semiconductor laser after elapse of a time required for control to be performed by the current control unit.

As mentioned above, continuous illumination of the semiconductor laser is effected, at a timing when formation of an image is not affected, only for a period of time used for control to be performed by the current control unit. Wherefore, even when fluctuations arise in the scan speed of the scanner unit, the current control unit can stably control, in the middle of continuous illumination, the current to be applied. Moreover, the continuous illumination of the semiconductor laser is commenced immediately after elapse of a period of time during which generation of an image is affected, and the period of continuous illumination can be prolonged even after the home position detection unit has detected the laser beam. Consequently, even when the period during which the home position detection unit detects the laser beam (i.e., the period of scan exposure effected by the scanner unit is comparatively short), the continuous illumination period used for control to be performed by the current control unit can be assured.

According to another exemplary embodiment of the present invention, there is provided an image forming apparatus comprising a semiconductor laser that emits a laser beam according with a current to be applied; a scanner unit that subjects a photosensitive element to scan exposure by the laser beam originating from the semiconductor laser; a light power detection unit that detects a light power of laser beam from the semiconductor laser; a current control unit that controls the current applied to the semiconductor laser according to the light power detected by the light power detection unit; a home position detection unit that detects the laser beam at a scan home position of the scanner unit; a continuous illumination unit that induces continuous illumination of the semiconductor laser for operation of the current control unit and the home position detection unit; and a determination unit that computes a period during which illumination of the semiconductor laser affects generation of an image and that determines if a period from end of the period until timing at which the home position detection unit is forecast to detect the laser beam a next time is longer than a time used for control to be performed by the current control unit, wherein the continuous illumination unit, when the determination unit determines that the period is longer than the time used for control to be performed by the current control unit, commences continuous illumination of the semiconductor laser at timing, a period of time or more used for control to be performed by the current control unit, ahead of timing at which the home position detection unit is forecast to detect the laser beam; and the continuous illumination unit, when the determination unit determines that the period is shorter than the time used for control to be performed by the current control unit, commences continuous illumination of the semiconductor laser after elapse of a period during which illumination of the semiconductor laser affects generation of an image and terminates continuous illumination of the semiconductor laser after elapse of the time used for control to be performed by the current control unit.

Thus, the scanner unit subjects the photosensitive element to scan exposure by the laser beam originating from the semiconductor laser. The continuous illumination unit induces continuous illumination of the semiconductor laser.

During the course of continuous illumination, the light power detection unit detects the light power of a laser beam originating from the semiconductor laser. The current control unit controls the current applied to the semiconductor laser on the basis of the light power. Moreover, the home position detection unit detects the laser beam at the scan home position of the scanner unit during the course of continuous illumination. Further, the determination unit computes a period of time during which illumination of the semiconductor laser affects generation of an image and determines if an interval from the end of the period until timing at which the home position detection unit forecasts to detect the laser beam a next time is longer than the time used for control to be performed by the current control unit.

When the determination unit determines that the period is longer than the time used for control to be performed by the current control unit, the continuous illumination unit commences continuous illumination of the semiconductor laser at timing, a period of time or more used for control to be performed by the current control unit, ahead of timing at which the home position detection unit is forecast to detect the laser beam. In this case, even when fluctuations arise in the scan speed of the scanner unit, the current control unit can stably control, in the middle of continuous illumination, the current to be applied. In this case, the home position detection unit detects the laser beam when continuous illumination is performed only for a time used for control to be performed by the current control unit. Hence, continuous illumination can be terminated immediately after the home position detection unit has detected the laser beam.

In a case where the period during which the home position detection unit detects the laser beam is short, such control may affect generation of an image when the photosensitive element is exposed to the laser beam at the time of commencement of continuous illumination of the semiconductor laser. Accordingly, when the determination unit determines that the interval from the end of the period during which illumination of the semiconductor laser affects generation of an image until timing at which the home position detection unit is forecast to detect the laser beam next time is shorter than the period of time used for control to be performed by the current control unit, the continuous illumination unit effects continuous illumination at the following timing. Specifically, in this case, the continuous illumination unit commences continuous illumination of the semiconductor laser after elapse of the period during which illumination of the semiconductor laser affects generation of an image. After elapse of the time used for control to be performed by the current control unit, continuous illumination of the semiconductor laser is terminated.

Accordingly, when the period of scan exposure becomes comparatively short as a result of occurrence of fluctuations in the scan speed of the scanner unit, the period of continuous illumination can be prolonged only for a period used for control to be performed by the current control unit even after the home position detection unit has detected the laser beam. Accordingly, the current control unit can stably control the current to be applied, during the course of continuous illumination. Even when the period of scan exposure performed by the scanner unit is comparatively short, the period of continuous illumination used for control to be performed by the current control unit can be assured.

Moreover, in the image forming apparatus according to exemplary embodiments of the present invention, continuous illumination of the semiconductor laser to be performed by the continuous illumination unit may also be carried out only when a period of scan exposure performed by the scanner unit is controlled so as to fall within a threshold range. In this case, continuous illumination, operation of the current control unit, and operation of the home position detection unit are performed in a period of time during which the period of scan exposure performed by the scanner unit is controlled so as to fall within a threshold range. Hence, occurrence of fault operations of the current control unit and the home position detection unit can be prevented.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

a semiconductor laser that emits a laser beam, light power of the laser beam being controllable by a current applied to the semiconductor laser;

a scanner unit that exposes a photosensitive element by scanning the photosensitive element using the laser beam;

a light power detection unit that detects light power of the laser beam;

a current control unit that controls the current applied to the semiconductor laser according to the light power of the laser beam;

a home position detection unit that detects whether the laser beam is positioned at a scan home position; and a continuous illumination unit that computes a length of time during which illumination of the semiconductor laser is used to form an image, based on a timing at which the home position detection unit detects the laser beam; commences continuous illumination of the semiconductor laser after an elapse of the length of time which is computed; and terminates continuous illumination of the laser after an elapse of an amount of time taken for control to be performed by the current control unit.

2. The image forming apparatus according to claim 1, wherein continuous illumination of the semiconductor laser is carried out only if a length of the scan exposure is controlled so as to fall within a threshold range.

3. An image forming apparatus comprising:

a semiconductor laser that emits a laser beam, light power of the laser beam being controllable by a current applied to the semiconductor laser;

a scanner unit that exposes a photosensitive element by scanning the photosensitive element using the laser beam;

a light power detection unit that detects light power of the laser beam;

a current control unit that controls the current applied to the semiconductor laser according to the light power of the laser beam;

a home position detection unit that detects whether the laser beam is positioned at a scan home position;

a continuous illumination unit that induces continuous illumination of the semiconductor laser for operation of the current control unit and the home position detection unit; and a determination unit that computes an illumination time period during which illumination of the semiconductor laser is used to generate an image, and that determines if a length of time from an end of the illumination time period until a forecast time at which the home position detection unit is forecast to detect the laser beam a next time is longer than a control time taken for control to be performed by the current control unit, wherein if the determination unit determines that the length of time is longer than the control time, the continuous illumination unit commences continuous illumination of the semiconductor laser at a time which is prior to the forecast time by a length of time equal to or greater than the control time; and if the determination unit determines that the period of time is shorter than the control time, the continuous illumination unit commences continuous illumination of the laser after an elapse of a length of time equal to the illumination time period, and terminates continuous illumination of the semiconductor laser after an elapse of a length of time equal to the control time.

4. The image forming apparatus according to claim 3, wherein continuous illumination of the semiconductor laser is carried out only if a length of the scan exposure is controlled so as to fall within a threshold range.

5. An image forming apparatus comprising:

a semiconductor laser that emits a laser beam, light power of the laser beam being controllable by a current applied to the semiconductor laser;

a scanner unit that exposes a photosensitive element by scanning the photosensitive element using the laser beam;

a light power detection unit that detects light power of the laser beam;

a current control unit that controls the current applied to the semiconductor laser according to the light power of the laser beam;

a home position detection unit that detects whether the laser beam is positioned at a scan home position;

a processing unit; and memory having machine readable executable instructions thereon that, when executed by the processing unit, perform the steps of:

computing a length of time during which illumination of the semiconductor laser is used to form an image, based on a timing at which the home position detection unit detects the laser beam;

commencing continuous illumination of the semiconductor laser after an elapse of the length of time which is computed; and terminating continuous illumination of the laser after an elapse of an amount of time taken for control to be performed by the current control unit.

6. The image forming apparatus according to claim 5, wherein continuous illumination of the semiconductor laser is carried out only if a length of the scan exposure is controlled so as to fall within a threshold range.

7. An image forming apparatus comprising:

a semiconductor laser that emits a laser beam, light power of the laser beam being controllable by a current applied to the semiconductor laser;

a scanner unit that exposes a photosensitive element by scanning the photosensitive element using the laser beam;

a light power detection unit that detects light power of the laser beam;

a current control unit that controls the current applied to the semiconductor laser according to the light power of the laser beam;

a home position detection unit that detects whether the laser beam is positioned at a scan home position;

a processing unit; and memory having machine readable executable instructions thereon that, when executed by the processing unit, perform the steps of:

inducing continuous illumination of the semiconductor laser for operation of the current control unit and the home position detection unit; and computing an illumination time period during which illumination of the semiconductor laser is used to generate an image, and determining if a length of time from an end of the illumination time period until a forecast time at which the home position detection unit is forecast to detect the laser beam a next time is longer than a control time taken for control to be performed by the current control unit, wherein if it is determined that the length of time is longer than the control time, commencing continuous illumination of the semiconductor laser at a time which is prior to the forecast time by a length of time equal to or greater than the control time; and if it is determined that the period of time is shorter than the control time, commencing continuous illumination of the laser after an elapse of a length of time equal to the illumination time period, and terminating continuous illumination of the semiconductor laser after an elapse of a length of time equal to the control time.

8. The image forming apparatus according to claim 7, wherein continuous illumination of the semiconductor laser is carried out only if a length of the scan exposure is controlled so as to fall within a threshold range.

* * * * *